US006234650B1

(12) United States Patent
Kincade

(10) Patent No.: US 6,234,650 B1
(45) Date of Patent: May 22, 2001

(54) STAR WITHIN A STAR ORNAMENTAL DECORATIVE ARTICLE

(76) Inventor: Christopher L. Kincade, 3707 Old Brownsboro Hills Rd., Louisville, KY (US) 40241-1632

( * ) Notice: Subject to any disclaimer, the term of this patent is extended or adjusted under 35 U.S.C. 154(b) by 0 days.

(21) Appl. No.: 09/356,590

(22) Filed: Jul. 19, 1999

(51) Int. Cl.[7] ..... F21V 21/00; F21W 121/00
(52) U.S. Cl. ..... 362/252; 362/227; 362/807
(58) Field of Search ..... 362/227, 249, 362/252, 367, 806, 807, 225, 382; 206/419–422

(56) References Cited

U.S. PATENT DOCUMENTS

| | | | | |
|---|---|---|---|---|
| 379,265 | * | 3/1888 | Best | 362/367 |
| D. 383,556 | | 9/1997 | Wang | D26/25 |
| 1,309,784 | * | 7/1919 | Spencer | 362/252 |
| 1,722,886 | | 7/1929 | Beck | 362/252 |
| 1,832,576 | | 11/1931 | Palmer | 362/252 |
| 2,696,596 | | 12/1954 | Eurich | 362/252 |
| 2,722,317 | | 11/1955 | Goodwin | 362/252 |
| 2,894,345 | | 7/1959 | Bushnell | 362/252 |
| 3,184,366 | | 5/1965 | Claude | 362/252 |
| 3,400,263 | | 9/1968 | Yakim | 362/252 |
| 3,704,367 | * | 11/1972 | Korb | 362/252 |
| 4,523,260 | | 6/1985 | Duncan | 362/121 |
| 4,537,806 | | 8/1985 | Sherrard | 428/7 |
| 5,297,012 | * | 3/1994 | Fletcher | 362/252 |

* cited by examiner

*Primary Examiner*—Alan Cariaso
(74) *Attorney, Agent, or Firm*—Charles G. Lamb; Middleton & Reutlinger

(57) ABSTRACT

A five pointed star decorative article is made up of ten identical symmetrical trapezoidal-shaped elongated members. Each elongated member is provided with a first terminating end and an opposed second terminating end wherein the angles of the first and second ends to a common side of the elongated member is of a totality of 108°. Each of the first terminating ends of the elongated members are mateable with corresponding first terminating ends of other elongated members and each second terminating end of the elongated member is mateable with a second terminating end of other elongated members thereby connecting first terminating ends with first terminating ends and second terminating ends with second terminating ends which forms a five pointed star within a five pointed star shaped decorative article.

14 Claims, 4 Drawing Sheets

STAR WITHIN A STAR ORNAMENTAL DECORATIVE ARTICLE

BACKGROUND OF THE INVENTION

This invention relates to an ornamental decorative article in the form of a star especially suitable for use as a Christmas decoration and more particularly relates to a star within a star ornamental decorative article.

There are a number of decorative display devices used in homes and businesses in celebration of the Christmas season. Some of the most popular displays used are decorative five-pointed star articles. These five-pointed stars may include lighting fixtures therein wherein the lights are arranged in a five-pointed star configuration thereby making these decorative stars useable indoors and outdoors and, particularly useful at night. Since these star-like decorations are only used during the Christmas season they are generally placed in storage during the remaining portion of the year. However, many of these display articles are quite bulky and therefore occupy or take up a considerable amount of space in storage. Moreover, many of these star like devices, if left in their star like configuration, may be damaged if not packed carefully. And, such packing is not generally easy because of the size and odd shape of the star shaped ornament.

SUMMARY OF THE INVENTION

It is an object of the present invention to provide an ornamental decoration of a five-pointed star shaped configuration.

It is another object of the present invention to provide an ornamental decoration of a five-pointed star-shaped design within a five-star pointed shaped decorative article.

It is a further object of the present invention to provide a five-pointed star-shaped configured ornamental decoration which is easily storable when not in use.

It is even a further object of the present invention to provide a five-pointed star-shaped configured decorative article which is formed of ten symmetrical identically-shaped trapezoidal configured elongated members.

It is also an object of the present invention to provide a five pointed star-shaped ornamental decoration with illuminated devices therein.

It is still a further object of the present invention to provide an improved five pointed star-shaped ornamental decoration which involves relatively few parts, which is easy to install, economical to operate, and takes up relatively little storage space.

More particularly, the present invention provides a five pointed star shaped decoration which is made up of ten symmetrical elongated longitudinally extending members of trapezoidal configuration. Each of the elongated members is provided with parallel sides and opposed first and second terminating ends wherein the inner angles of the first and second ends to a common side is a totality of 108 degrees. Each of the first ends of the elongated members is attached to a corresponding first end of an another elongated member and each of the second ends is attached to a second end of another elongated terminating member whereby the connecting of the ten elongated members forms a five-pointed star.

Further objects and advantages of the invention will become apparent from the following detailed description of the preferred embodiments and from the accompanying drawings.

DETAILED DESCRIPTION OF THE PREFERRED EMBODIMENT

Figure 1:
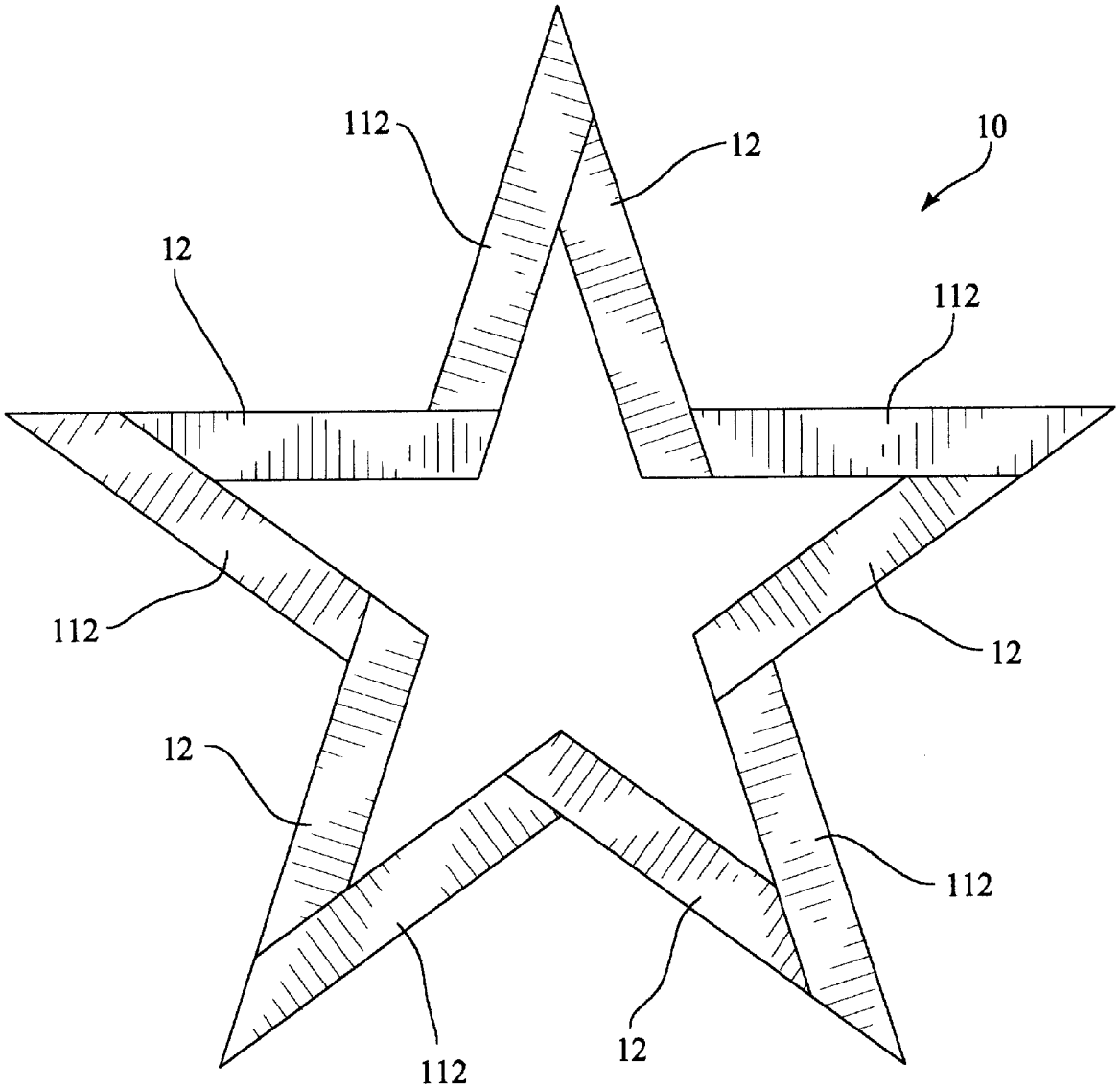
FIG. 1 is a top view of one five pointed star decorative article of the present invention.
Figure 2:
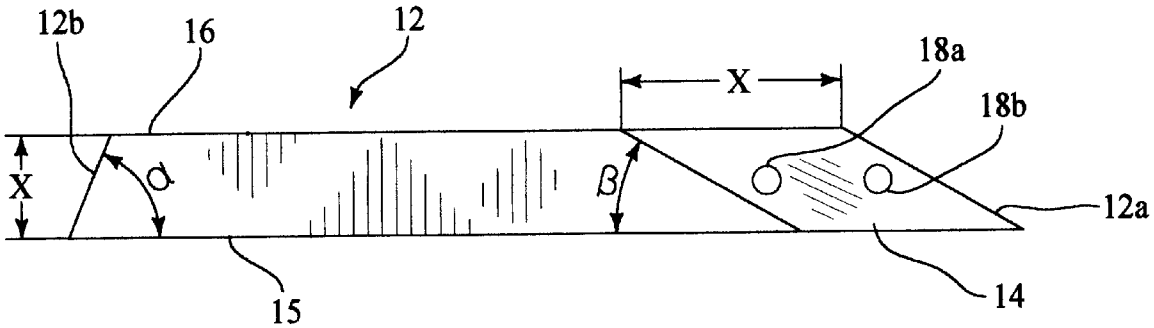
FIG. 2 is a top view of one elongated member making up the star-shaped article of FIG. 1.
Figure 3:
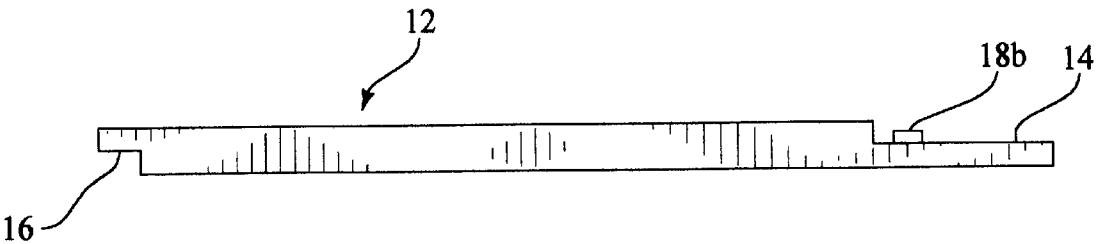
FIG. 3 is a side view of the elongated member of FIG. 2.
Figure 4:
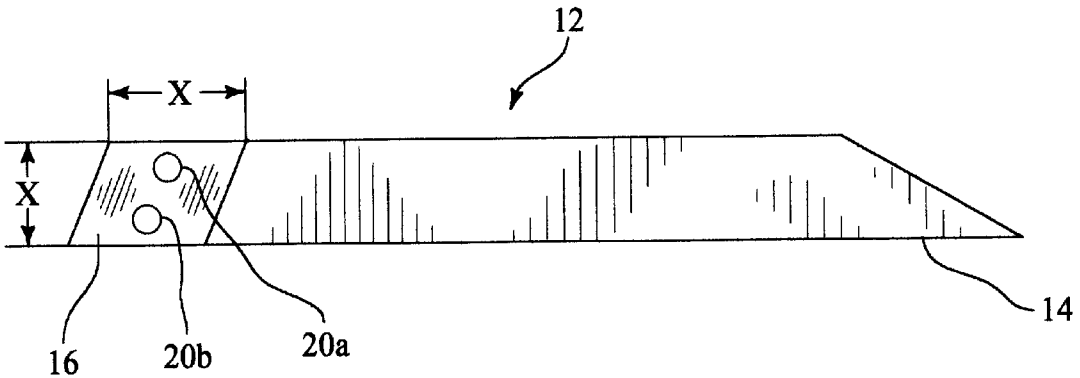
FIG. 4 is a bottom view of the elongated member of FIG. 2.
Figure 5:
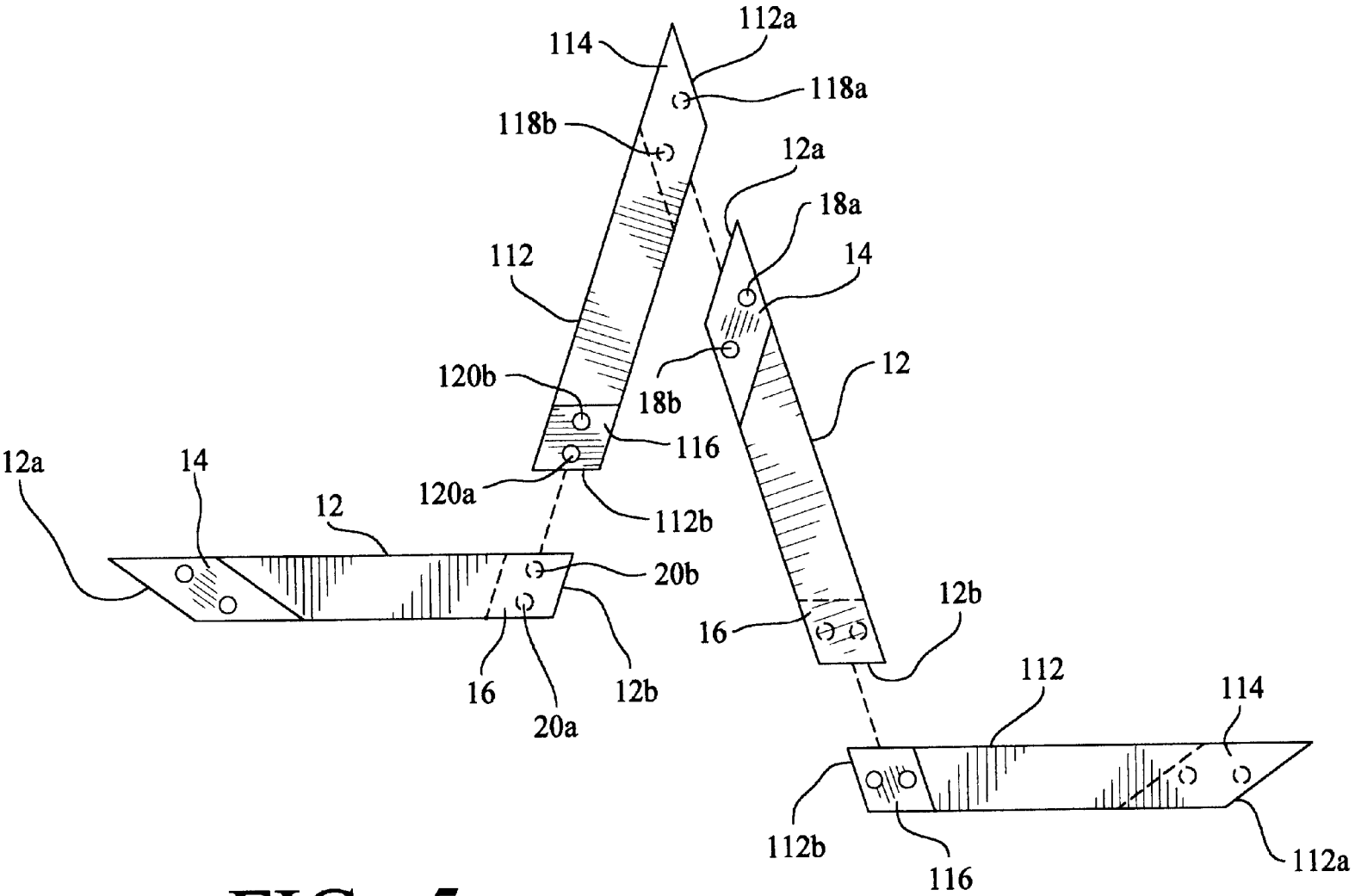
FIG. 5 is a top view of a plurality of elongated members of FIG. 1 shown in a disassembed attaching arrangement.

As shown in FIGS. 1–5, the five-pointed star-shaped ornamental decoration 10 is made up of ten trapezoidal-shaped elongated members of identical configuration identified by the numerals 12 and 112. As shown, each elongated member 12 is attached at opposite terminating ends to an elongated member 112 and each elongated member 112 is attached at opposite terminating ends to elongated member 12. As best shown in FIG. 5, each terminating first end 14 of member 12 is connectable to an identical first terminating end identified by the numeral 114 of member 112 and each second end 16 of member 12 is connectable to an identical second terminating end 116 of the elongated member 112. The only difference between the elongated members 12 and 112 is in the fastening means so that a first terminating end 14 of elongated member 12 is mateable with a first terminating end 114 of elongated member 112; and, a second terminating end 16 of elongated member 12 is mateable with a corresponding second terminating end 116 of the elongated member 112. One example for connecting members 12 and 112, as best shown in FIGS. 2–4, may include a plurality of outwardly extending fingers 18*a* and 18*b* on elongated member 12 at the first terminating end 14 which are received within accommodating recesses 118*a* and 118*b* at the first terminating end 114 in elongated member 112. And, elongated fingers 20*a* and 20*b* of the terminating end 16 are engageable with receiving openings 120*a* and 120*b* of the terminating end 116 of the elongated member 112. Other means for attaching the terminating ends may be used, such as, bolts and nuts or any other means that may be appropriate, but snap in type fittings is one of the preferred.

As best shown in FIG. 2, the first terminating end 14 is provided with a terminating edge 12*a* which intersects side edge 15 at an angle $\beta$ and second terminating end 16 is provided with a terminating edge 12*b* which intersects side edge 15 at an angle $\alpha$. Angles $\alpha$ and $\beta$ equal a totality of 108°. Usually $\alpha$ is from 60° to 80°; preferably about 72° and $\beta$ is from 28° to 48°, preferably about 36°. Also, as shown in FIGS. 2 and 4, the first and second terminating ends 14 and 16 are L-shaped cut-out parallelogram-shaped portions wherein the width of the cut-out portions, identified by the letter "X" is the same as the width "X" of the elongated member 12. Moreover, each L-shaped cut-out includes a first cut portion extending transverse to the terminating end and a second cut portion extending parallel to the terminating end. And, elongated member 112 has corresponding terminating ends which are mirror images of terminating ends of elongated member 12. Thus, when members 12, 112 are connected, their terminating ends are superimposed.

Figure 6:
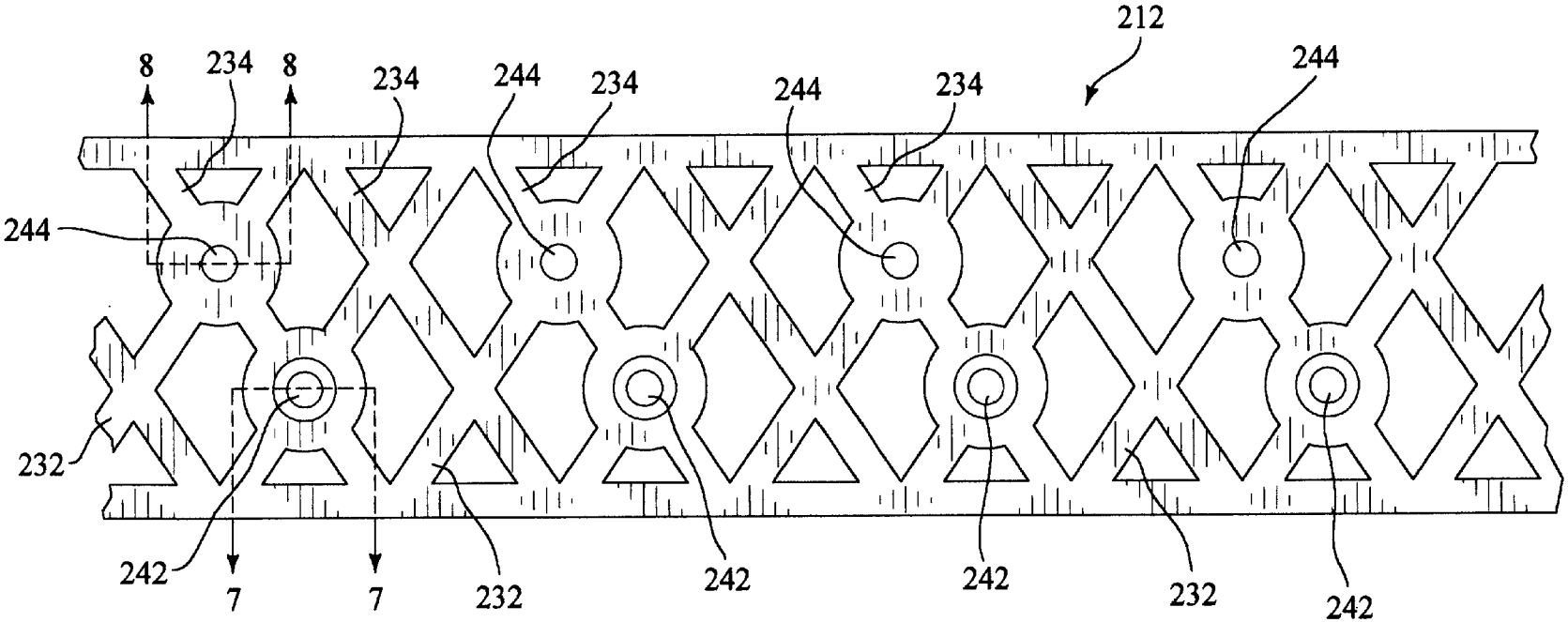
FIG. 6 is a enlarged top view, partially in section, of another embodiment of an elongated member of the present invention.
Figure 8:
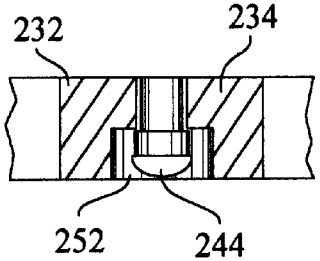
Figure 7:
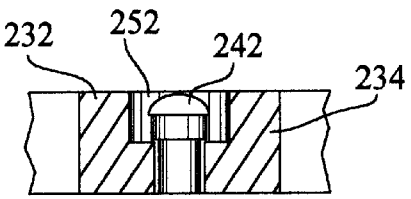
FIG. 7 is a sectional view taking along lines 7—7 of FIG. 6; and, FIG. 8 is a sectional view taking along lines 8—8 of FIG. 6.

In another embodiment, as shown in FIG. 6, an elongated member 212 is shown as including a plurality of first parallel bars 232 extending from opposed sides of elongated member 212 intersecting with a plurality of second elongated bars 234 also extending from opposed sides of elongated member 212. At alternating intersections of bars 232, 234 illuminating devices 242, 244 are provided. One-half of the illuminating devices identified by the numeral 242 extend outwardly in a first row along the face of the member 212 and a second row of the illuminating devices 244 extend outwardly from the back side of the elongated member 212. A plurality of lamp sockets are provided in the elongated member 212 for receipt of the illuminating devices 242, 244. As shown in FIGS. 7 and 8, counter-sunk sockets 252 are in the face and counter-sunk sockets 254 are provided in the back to receive the illuminating devices 242, 244 therein. Wires (not shown) providing the energy for lighting the lamps 242, 244 may be arranged in any type of arrangement throughout the elongated members.

Upon the assembling of the elongated members 12 and 112 as shown and described (FIG. 1) creates "a star within a star", the assembled star-shaped configuration being made from ten symmetrical trapezoidal-shaped parts, each part representing half a point of the star. This allows fabrication out of a molded plastic using only one or two injection molds, depending upon the preference of attaching means for members 12, 112.

It will be realized that various changes may be made to the specific embodiments shown and described without departing from the principals and spirit of the present invention.

What is claimed is:

1. A five pointed star decorative article comprising:

ten symmetrical elongated horizontally extending members of trapezoidal configuration having parallel sides and opposed first and second terminating ends, an inner angle of each said first and said second terminating ends to a common side being a totality of 108°, each terminating end being provided with a terminating edge and an L-shaped cut-out with a first cut portion extending transverse to said terminating edge and a second cut portion extending parallel to the terminating edge;

each of said first terminating ends being attachable to other first terminating ends and each of said second terminating ends being attachable to other said second terminating ends.

2. The decorative article of claim 1, said first cut portion having a length equal to a width of said elongated member.

3. A five pointed star decorative article comprising:

ten symmetrical elongated horizontally extending members of trapezoidal configuration having parallel sides and opposed first and second terminating ends, an inner angle of each said first and second ends to a common side being a totality of 108°, each terminating end having one opposed pair of edges having lengths equal to a width of said elongated member; and, each of said first terminating ends being attachable to other first terminating ends and each of said second terminating ends being attachable to other said second terminating ends.

4. The decorative article of claim 1 wherein a first five of said elongated members have first fittings on each terminating end and a second five of said elongated members having second fittings on each terminating end, said first fittings on said terminating ends of said first five members being in cooperating relation with said second fittings on said terminating ends on said second five members.

5. The decorative article of claim 1, each elongated member having a plurality of lights affixed therealong at preselected positions.

6. The decorative article of claim 5 wherein said lights are on a face and a back of said elongated members.

7. A five pointed star decorative article comprising:

ten symmetrical elongated horizontally extending members of trapezoidal configuration having parallel sides and opposed first and second terminating ends, an inner angle of each said first and said second terminating ends to a common side being a totality of 108° wherein said first terminating end is between 60° and 80° to said common side and said second terminating end is between 28° and 48° to said common side of each of said ten elongated members, each of said first terminating ends being attachable to other first terminating ends and each of said second terminating ends being attachable to other said second terminating ends.

8. The decorative article of claim 7 wherein said first terminating end is at an angle of approximately 72° and said second terminating end is at an angle of approximately 36° to said common side of said elongated member.

9. The decorative article of claim 3 wherein a first five of said elongated members have first fittings on each terminating end and a second five of said elongated members having second fittings on each terminating end, said first fittings on said terminating ends of said first five members being in cooperating relation with said second fittings on said terminating ends on said second five members.

10. The decorative article of claim 3, each elongated member having a plurality of lights affixed therealong at preselected positions.

11. The decorative article of claim 10 wherein said lights are on a face and a back of said elongated members.

12. The decorative article of claim 7 wherein a first five of said elongated members have first fittings on each terminating end and a second five of said elongated members having second fittings on each terminating end, said first fittings on said terminating ends of said first five members being in cooperating relation with said second fittings on said terminating ends on said second five members.

13. The decorative article of claim 7, each elongated member having a plurality of lights affixed therealong at preselected positions.

14. The decorative article of claim 13 wherein said lights are on a face and a back of said elongated members.

* * * * *